United States Patent [19]

Bordalen

[11] Patent Number: 4,777,466

[45] Date of Patent: Oct. 11, 1988

[54] CONNECTOR ARRANGEMENT FOR ELECTRICAL CIRCUITS IN UNDERWATER INSTALLATIONS, AND TRANSFORMER PARTICULARLY FOR USE IN SUCH ARRANGEMENT

[75] Inventor: Knut Børdalen, Stabekk, Norway

[73] Assignee: Senter for Industriforskning, Oslo, Norway

[21] Appl. No.: 9,328

[22] PCT Filed: Apr. 18, 1986

[86] PCT No.: PCT/NO86/00032

§ 371 Date: Dec. 12, 1986

§ 102(e) Date: Dec. 12, 1986

[87] PCT Pub. No.: WO86/06543

PCT Pub. Date: Nov. 6, 1986

[30] Foreign Application Priority Data

Apr. 25, 1985 [NO] Norway ..... 851669

[51] Int. Cl.[4] ..... H01F 27/28

[52] U.S. Cl. ..... 336/180; 336/182; 336/195; 336/212; 336/DIG. 2

[58] Field of Search ..... 336/195, 180, DIG. 2, 336/105, 107, 82, 83, 182, 192, 212, 175

[56] References Cited

U.S. PATENT DOCUMENTS

| | | | |
|---|---|---|---|
| 2,348,325 | 5/1944 | Brown | 336/195 X |
| 2,379,800 | 7/1945 | Hare | 336/83 X |
| 2,414,719 | 1/1947 | Cloud | 336/DIG. 2 |
| 2,967,267 | 1/1961 | Steinman et al. | 336/DIG. 2 X |
| 3,197,723 | 7/1965 | Dortort | 336/195 |
| 3,205,463 | 9/1965 | Thompson | 336/82 X |
| 3,453,574 | 7/1969 | DeParry | 336/195 X |
| 3,549,990 | 12/1970 | Hochheiser | 336/DIG. 2 X |
| 3,614,694 | 10/1971 | Koontz | 336/174 |
| 3,743,989 | 7/1973 | Nicolas et al. | 336/DIG. 2 X |
| 3,961,292 | 6/1976 | Davis | 336/195 X |
| 4,019,167 | 4/1977 | Barker | 336/107 X |
| 4,134,091 | 1/1979 | Rogers | 336/195 X |

FOREIGN PATENT DOCUMENTS

| | | | |
|---|---|---|---|
| 277896 | 3/1967 | Australia | 336/180 |
| 469891 | 3/1952 | Italy | 336/195 |
| 1124183 | 8/1968 | United Kingdom . | |
| 1462501 | 1/1977 | United Kingdom . | |
| 1468220 | 3/1977 | United Kingdom . | |
| 2020116 | 11/1979 | United Kingdom . | |

*Primary Examiner*—Thomas J. Kozma

*Attorney, Agent, or Firm*—Wenderoth, Lind & Ponack

[57] ABSTRACT

A transformer for current supply and/or signalling purposes, in particular for use in a connector arrangement for electrical circuits in underwater installations, includes a magnet circuit, a first winding having a plurality of turns and a second winding having one or very few turns, whereby turn portions of both windings pass essentially in parallel through one or more openings in the magnetic circuit. For obtaining advantageous electrical properties, turn portions of the first winding are so arranged that along a major part of their length which is surrounded by the magnetic circuit they are individually enclosed by that or those conductors which constitute the turn portions of the second winding that are surrounded by the magnetic circuit.

13 Claims, 3 Drawing Sheets

CONNECTOR ARRANGEMENT FOR ELECTRICAL CIRCUITS IN UNDERWATER INSTALLATIONS, AND TRANSFORMER PARTICULARLY FOR USE IN SUCH ARRANGEMENT

BACKGROUND OF THE INVENTION

In underwater installations as for example in association with offshore oil activity, the interconnection between cables or between cables and equipment modules, for example located at the sea bottom, presents serious problems. A specific type of inductive connector is described in Norwegian Patent Application No. 84.0087. The present invention takes as a basis a situation corresponding to that in such previous disclosure, but as will appear from the following, the present invention has also in part more general uses.

Corrosion and pitting of materials included in the structure of such connectors or the like constitute one of the greatest problems in underwater installations in sea water and also frequently at other forms of electrical installations in which it cannot always be guaranteed that corrosion protection and encapsulation will prevent penetration of for example water or moisture. In particular when there is ambient sea water it is to be noted that the voltage level in a part of the electrical installation has much significance to the corrosion rate. When the voltages exceed about 1 volt, the corrosion will take place much more quickly than at lower voltages. This recognition constitutes some of the background for the solutions set forth in the following.

When transmitting and distributing electrical energy and signals respectively through cables and wires there will normally be employed much higher voltage levels than 1 volt, depending upon the transmission distances concerned. This also applies to a high degree in underwater installations in offshore oil activity.

SUMMARY OF THE INVENTION

Thus, this invention, in a first aspect which is rather fundamental, relates to a connector arrangement for electrical circuits in underwater installations, comprising two connector parts adapted for mutually separable interconnection, preferably by inductive coupling. What is novel and specific to the arrangement according to the invention is that associated with at least one of the connector parts there is provided a transformer for transforming between a comparatively low voltage level over the connector and a comparatively high voltage level in an adjacent electrical circuit, for example a transmission cable. An advantageous embodiment in practice is obtained by assembling these coupling transformers with the connector into an integrated unit.

Depending upon the electrical circuit in which the connector is included, it may be necessary to have a transformer at both sides or only at one side of the connector. Two-sided transformation will be the more normal, for example when the interconnection of two lengths of a transmission cable is concerned. Moreover, there may be situations in which the voltage level in the system is so high that stepdown transforming to a low level across the connector must be effected by means of two or more transformers in series, as individual transformers in practical designs will have limitations with respect to the maximum conversion rate.

The present arrangement with the so-called coupling transformers imposes quite specific requirements to the transformer design. Another and essential aspect of this invention thus relates to a transformer suitable for this purpose. It will be realized, however, that the transformer to be described in the following can also be employed with advantage in other areas than in underwater installations as discussed above.

In this aspect the invention takes as a basis a transformer for current supply and/or signalling purposes, in particular for use in an arrangement comprising a magnetic circuit, a first winding having a plurality of turns and a second winding having one or very few turns, in which turn portions of both windings pass substantially in parallel through one or more openings in the magnetic circuit. What is novel and specific to the transformer according to the invention is that the turn portions of the first winding along a major part of its length surrounded by the magnetic circuit are individually enclosed by that or those conductors which constitute the turn portion(s) of the second winding enclosed by the magnetic circuit.

With such a solution it will be possible to obtain a very low ohmic resistance in the transformer, which is an advantage primarily with respect to self heating in power transmission, but also concerning a low attenuation in signal transmission. Besides, the transformer will have small leakage fields. This gives good properties at high signal frequencies and results in a low reactive voltage drop in power transmission.

BRIEF DESCRIPTION OF THE DRAWINGS

Various aspects of this invention shall be discussed more closely in the following with reference to the drawings, in which.

DETAILED DESCRIPTION OF THE INVENTION

Figure 1:
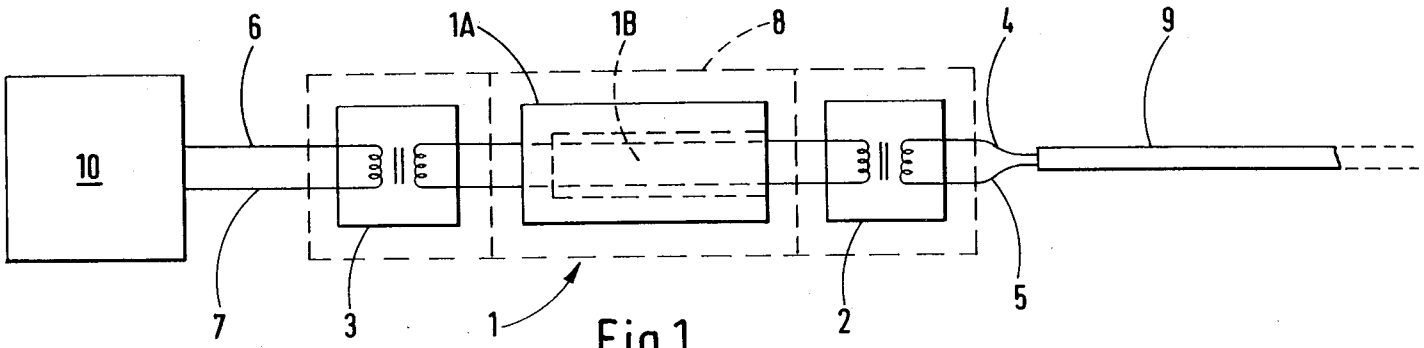
FIG. 1 is a diagram showing in principle an arrangement according to the invention.

FIG. 1 shows in principle and much simplified a portion of an underwater system with an electrical installation comprising a cable 9 which for example can serve to supply energy in the form of electric current to an equipment module 10, possibly also to convey signals to or from the module 10. In such an installation very often there will be a need for a separable connection, i.e. in the form of a connector, between the cable 9 and the equipment module 10. Corresponding requirements for a separable connection can also be present when two cable lengths are to be interconnected. In such situations there can for example be employed an inductive connector as described in the above Norwegian patent application. As previously mentioned it is of substantial significance, both in such inductive connectors and in other types of connectors, to keep the voltage level low across the connector in order thereby to contribute to minimizing corrosion and pitting, if the existing corrosion protection or encapsulation should be damaged.

In underwater systems or installations concerned the usual voltage level will be from 20 to 100 volts, depending inter alia upon the transmission distances. Thus, as shown in FIG. 1 and in accordance with the invention there are inserted transformers 2 and 3 connected to the equipment module 10 through wires 6 and 7 and to the cable 9 through wires 4 and 5, respectively. The transformer 3 is connected to a main part 1A of a connector 1, whereas the transformer 2 is connected to a separable part 1B of the connector. As indicated by broken lines 8 around the connector and both transformers, these components can be built together into an assembled unit, which is a substantial advantage in practice, particularly in order to obtain the shortest possible electrical connections between the two transformers 2 and 3 and the associated parts of the connector 1.

Figure 2:
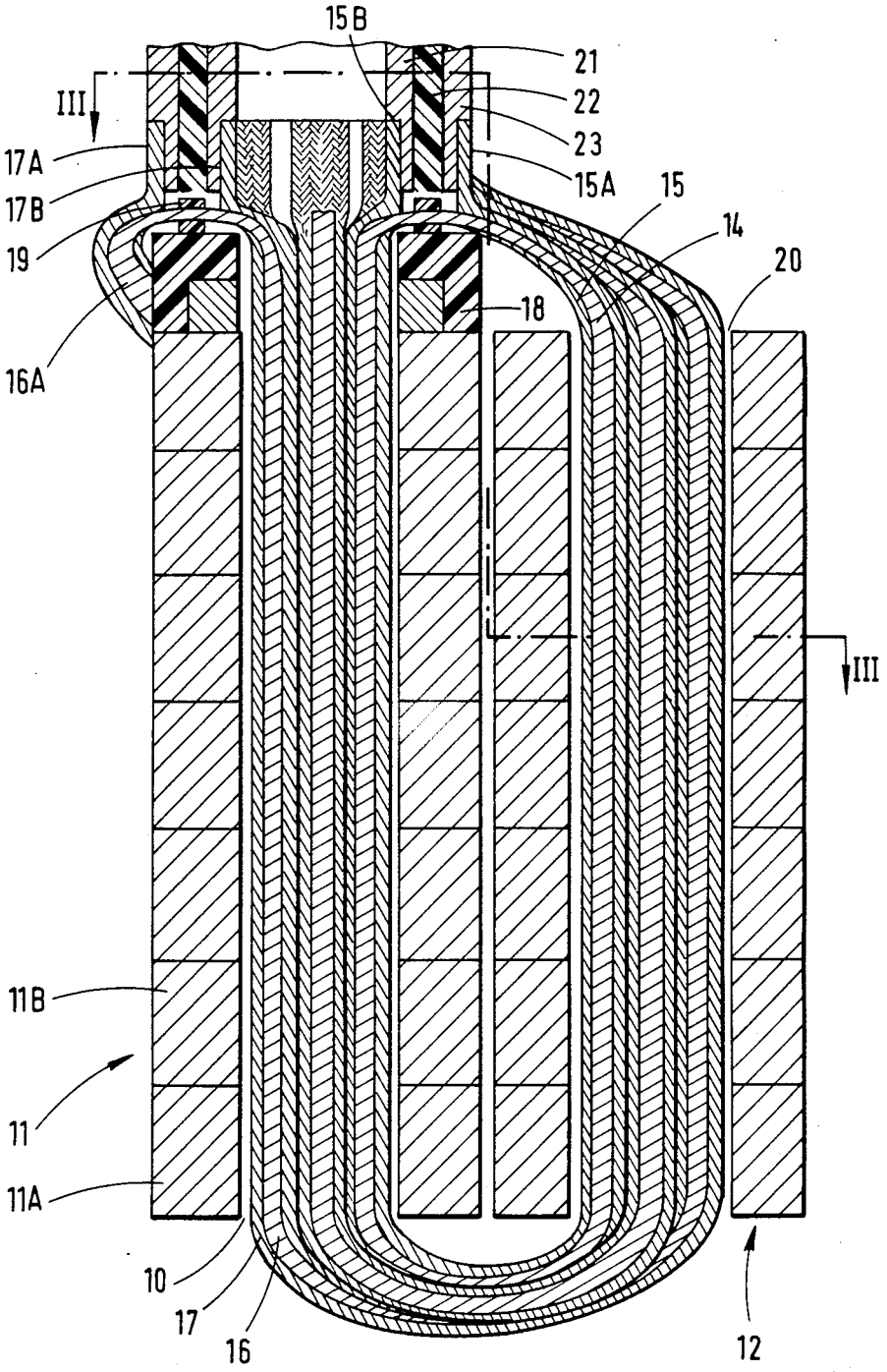
FIG. 2 is a simplified longitudinal section through a transformer designed according to the invention.
Figure 3:
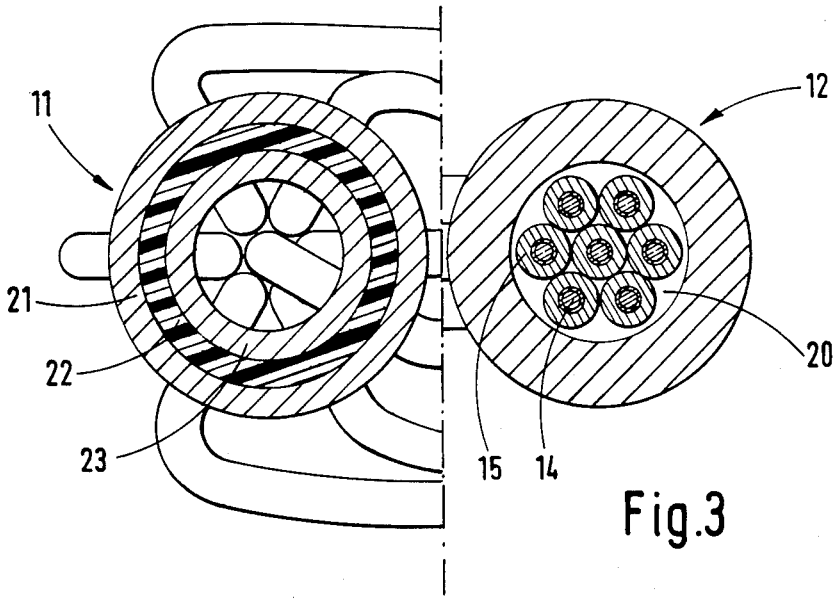
FIG. 3 is a cross-section along lines III—III in FIG. 2.

FIGS. 2 and 3 show a particular embodiment of a transformer for the above purpose and possibly other purposes in which similar properties are required. This transformer has a magnetic circuit composed of a plurality of toroidal cores, preferably of a ferrite material, forming two elongate tube-like core members 11 and 12. At the lower end of core member 11 there is specifically designated a toroidal core 11A. The transformer windings are passed through the through openings in both members 11, 12 of the magnetic circuit, with the major parts of the winding lengths or portions lying within these through openings and enclosed by the magnetic circuit. As will appear in particular from FIG. 2, the turn portions within the magnetic circuit core members will extend generally in parallel and rectilinear directions.

The windings in the embodiment of FIGS. 2 and 3 can be regarded as provided by a form of coaxial wire having an inner conductor forming winding portions indicated inter alia at 14 and 16, and an outer conductor having corresponding turn portions 15 and 17, as well as an intermediate insulation which can consist of a usual insulating material applied according to some conventional manufacturing method. Conveniently the inner conductor and the outer conductor can consist of copper, for example having a conductor cross-section composed of individual threads. For the manufacturing operation, it is moreover an advantage to employ an outer conductor in the form of a braided sleeve. The composite wire with inner conductor, intermediate insulation and outer conductor can be contemplated to be a finished product supplied by a cable manufacturer, or the sleeve can be pulled outside the winding portions during the application thereof on the magnetic circuit. Possibly there may also be provided an outer insulation around the outer conductor. This is not necessary if the winding formed by the outer conductors shall have only one single turn, which is a convenient embodiment in many cases.

FIG. 3 shows inter alia a cross-section of the magnetic circuit member 12 in which a through opening 20 accommodates the windings which here consist of seven inner and outer conductors, of which one inner conductor 14 is specifically indicated with an associated outer conductor 15.

A first winding, which can for example be considered to be the primary winding, is formed of all turns of the inner conductor, of which the turn portions 14 and 16 have been mentioned above. The first winding has an end, for example as designated at 16A, and forms a total number of turns adjusted according to the desired conversion rate, and another winding end (not shown) which can also be located adjacent the upper end of the magnetic circuit in FIG. 2.

The other winding which may be regarded as the secondary winding comprises inter alia the above turn portions 15 and 17 which individually enclose the respective inner conductors 14 and 16. However, the outer conductor is interrupted, for each turn of the inner conductor, at the top of the magnetic circuit core member 11, where all of the outer conductor parts are connected in parallel so as to form a single turn which constitutes the other winding. This parallel connection is effected such that the two free ends of the outer conductor sleeve which are formed by the above interruption or cutting thereof adjacent the top of the magnetic circuit core member 11 are connected to output leads in the form of two coaxial copper tubes 21 and 23 the lower ends of which are shown at the top of FIG. 2. Between the copper tubes there is indicated an insulation layer 22.

As more specifically shown in FIG. 2, at the outer conductor 17 there are formed two output leads 17A and 17B which for example by soldering are connected to the respective copper tubes 23 and 21. Correspondingly at the outer conductor 15 there are shown output leads 15A and 15B connected to the copper tubes at a location diametrically opposite the connection of the above output leads 17A and 17B. In this manner all separate individual turns formed by the outer conductor sleeves which enclose respective turns of the inner conductor are connected in parallel so as to form the other winding consisting of a single turn. As will appear in particular from the cross-section through the core member 12 in FIG. 3, the conductor cross-section of the composite turn which constitutes the other winding is thus distributed around the inner conductor turns which constitute the first winding, so that each turn portion of the first winding is completely surrounded by a portion of the conductor cross-section of the other winding. This composition of the windings is very significant for attaining the particular and advantageous properties possessed by the transformer according to the invention, especially for the purpose of being employed according to the principle which appears from FIG. 1.

The structure at the upper end of the magnetic circuit member 11 in FIG. 2, with the coaxial output leads in the form of copper tubes 21 and 23 the diameters of which correspond approximately to the diameter of the toroidal cores (for example core 11A) forming the magnetic circuit members, provides a very convenient mechanical and electrical junction between the transformer windings, in particular the other winding and adjacent electrical circuits, in particular an inductive connector as referred to above. In order to keep the individual turns orderly at the top of the magnetic circuit, there is provided a top member 18 on the uppermost toroidal core in member 11. This top member 18 can for example be made of a plastic material and has a row of dividers 19 on its upper face. Between the dividers 19 there are interstices corresponding approximately to the diameter of the inner conductor so that all inner conductor turns can be located and kept in fixed positions around the circumference, with the associated output leads formed by the surrounding outer conductor sleeves extended upwardly for connection to the copper tubes 21 and 23 as explained above. The left portion of FIG. 3 shows how some of the winding parts are arranged around the upper portion of the magnetic circuit member 11. It will be realized that there may be a narrow space for arranging the individual turn portions in the region between the lower ends of tubes 21 and 23 and the top of the magnetic circuit. With the coaxial arrangement described and said top member 18 with dividers 19, it is possible, however, to obtain a convenient arrangement in practice.

For obtaining the best possible electrical properties it is an advantage that the inner conductor in the region of the dividers 19, i.e. between the output leads, for example output leads 17A and 17B belonging to the turn portion or outer conductor 17, be as short as possible. Another relationship of significance is that for the interesting configurations of primary and secondary windings it is an advantage that the cross-sectional area of the inner conductor and the cross-sectional area of the outer conductor are approximately equal, since this will result in the same current density in the windings. With a magnetic circuit composed of toroidal cores as described and based upon a ferrite material, the transformer will have small losses at signal frequencies up to 1 MHz or more. For a possible practical application the conversion rate of the transformer can be 19:1 based upon galvanically separated windings. However, the winding arrangement can easily be switched so as to obtain an autotransformer having a conversion rate of 20:1.

In the transformer there is aimed at a counteraction of the current skin effect in the other (and low voltage) winding at the same time as the leakage reactance of the transformer is maintained as low as possible. Thus, there is obtained a very good current distribution in this winding.

In combined utilization partly for power transmission at a moderate frequency, for example up to a few hundred Hz, at the same time as there are to be transmitted signals having a significantly higher frequency, the design of the invention has proved to be very advantageous. At the lower or moderate current supply frequency there will be a good utilization of the conductor cross-sectional area of the turns because of a small skin effect, but at higher signal frequencies the skin effect may become significant. The latter may in the first instance be taken as a disadvantage, but on the contrary involves an advantage because this skin effect will be accompanied by a reduction in the leakage field and thereby in a reactive voltage drop at signal frequencies. At these frequencies this is more significant than the purely ohmic voltage drop. Under no circumstances will the signal transmission lead to any undesired heating of the transformer.

The illustrated connection to the tubular output leads contributes to the above advantages by not introducing unnecessary reactance.

In a manner known per se the capacity between both windings can be influenced by the choice of materials and dimensions of the winding wire, including the insulation thickness and the dielectric constant, so as to adapt or improve the transmission for the most high-frequency signals to be transmitted.

Figure 4:
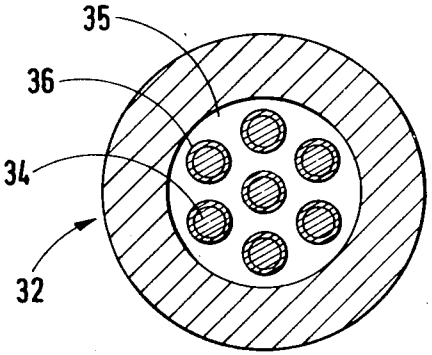
FIG. 4 is a cross-section through a magnetic circuit with windings as an alternative to the embodiment shown in FIGS. 2 and 3.

FIG. 4 shows another embodiment of the windings, as seen in a cross-section corresponding to the right part of FIG. 3. In FIG. 4 there is shown a magnetic circuit having a toroidal core 32 as in the embodiment discussed above, and the through opening thereof accommodates a single turn in the form of a solid copper member 35 provided with through holes 36 in which are inserted turn portions 34 which together constitute a winding having several turns as previously described. The turn portions 34 are of course insulated within the holes 36. Manufacturing reasons, inter alia depending upon how many of such transformers are to be manufactured, will contribute to the decision as to whether an embodiment as shown simplified in FIG. 4, can be an interesting alternative to the embodiment according to FIGS. 2 and 3. Also other practical embodiments may be contemplated on the basis of the fundamental features of the transformer according to the invention, namely that turn portions of the first winding (for example the primary winding), along a major part of the lengths thereof enclosed by the magnetic circuit, are individually enclosed by that or those conductors which constitute the turn portions of the other winding which are enclosed by the magnetic circuit. As will be apparent from the above, it is also an advantage when this "coaxial" arrangement of turn portions, in the form of an inner conductor and an associated outer conductor, continues outside the magnetic circuit in the shortest possible lengths of the turns which extend outside the magnetic circuit.

Figure 5:
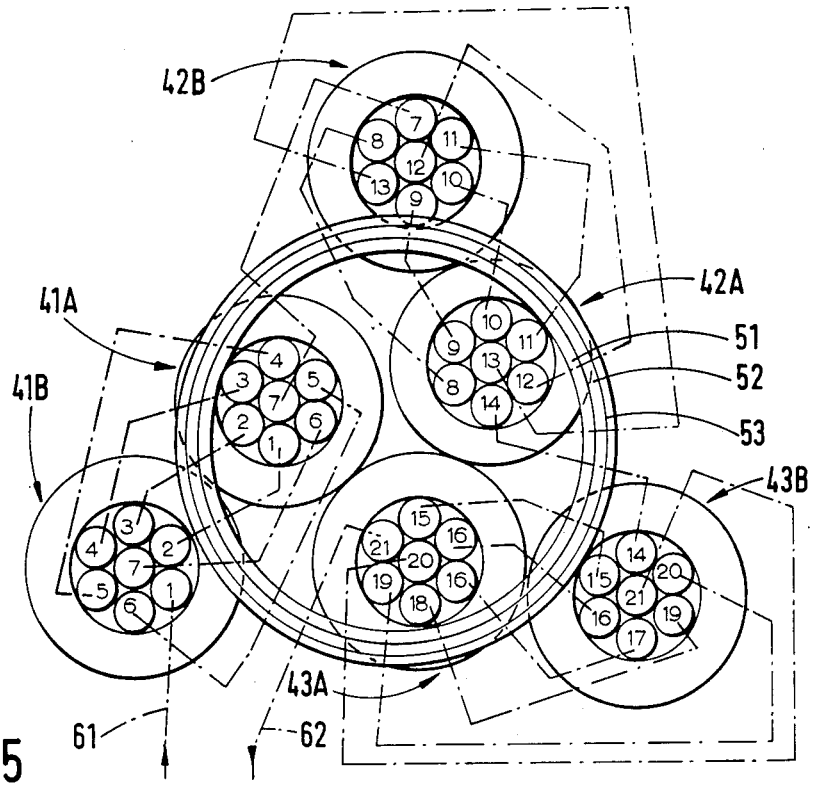
FIG. 5 is a schematic view showing in principle an assembly of several (three) transformers connected into a group for obtaining a higher total conversion rate, possibly also an increased power capacity.

In certain practical uses it can be necessary to employ relatively nhigh conversion rates or to accommodate comparatively high power. Several such transformers can then be interconnected into a group by connecting in parallel the other windings (the low voltage windings) and by connecting in series the first windings (the primary winding). A simplified example of such an arrangement is shown in FIG. 5. Here there are schematically indicated three transformers of the type described about and having respective magnetic circuit members 41A–41B, 42A–42B and 43A–43B. There are assembled into a star-like arrangement having a common output in the form of coaxial tubes 51 and 53 with an intermediate insulation 52 in analogy to the tubular output leads at the top of FIG. 2. Output leads from the low voltage windings, for example in the form of sleeve ends as previously described, are then connected to the tubes 51 and 52 at separate locations so that the three transformers each have a sector of about 120° of the circumference of the coaxial lead tubes 51 and 53. Moreover, there is indicated how the turns of the first windings ("primary winding") of these transformers can be connected in series so as to form a transformer arrangement having a higher conversion rate than that of each individual transformer.

It is obvious that the principles on which this invention is based can be realized in several practical ways other than the exemplary embodiments described and illustrated herein. Among other things it is clear that the magnetic circuit may be composed or formed in other ways than by means of toroidal cores subdivided into two magnetic circuit members each having a respective tunnel-like through opening for the windings. Quite corresponding or perhaps better electrical and magnetic properties may be obtainable with a magnetic circuit consisting of one integrated unit, for example of a ferrite material, provided with two through winding openings having a relatively large length compared to the transverse dimension.

I claim:

1. A connector arrangement for electrical current supply and/or signalling circuits in underwater installations, said arrangement comprising a connector including two connector parts capable of mutually separable interconnection by inductive coupling, at least one of said connector parts having operatively connected thereto transformer means for transforming between a relatively low voltage level in said connector and a relatively high voltage level in an adjacent electrical circuit, said transformer means comprising:

a magnetic circuit having therethrough at least one opening;

a first winding having a plurality of turns and a second winding having at least one turn, portions of said turns of both said first and second windings passing through said opening and being surrounded by said magnetic circuit; and each said turn portion of said first winding, over a major part of the length thereof surrounded by said magnetic circuit, being individually enclosed by said portion of said at least one turn of said second winding that is surrounded by said magnetic circuit.

2. An arrangement as claimed in claim 1, wherein said opening extends rectilinearly through said magnetic circuit, and said turn portions extend substantially parallel through said opening.

3. An arrangement as claimed in claim 1, wherein said magnetic circuit has therethrough plural openings through which extend said turn portions.

4. An arrangement as claimed in claim 1, wherein said second winding includes only a single turn, said portion of said single turn surrounded by said magnetic circuit comprises a single solid metal member having an outer dimension substantially filling said opening in said magnetic circuit, said solid metal member has therethrough a plurality of holes, and said turn portions of said first winding extend through respective individual said holes in said solid metal member.

5. An arrangement as claimed in claim 1, wherein said first and second windings are formed by a wire including an inner conductor forming said turns of said first winding, an outer conductor coaxially surrounding said inner conductor, and an insulation layer between said inner and outer conductors, said outer conductor being electrically interrupted at spaced intervals to form a plurality of outer conductor sections corresponding in number to the number of complete turns of said inner conductor, said outer conductor sections being connected in groups in parallel to form said second winding.

6. An arrangement as claimed in claim 5, further comprising an insulating sheath surrounding said outer conductor.

7. An arrangement as claimed in claim 5, wherein said second winding includes only a single turn formed by the parallel connection together of all of said outer conductor sections.

8. An arrangement as claimed in claim 7, wherein the outer surface of said outer conductor is free of insulation.

9. An arrangement as claimed in claim 5, wherein said outer conductor comprises a braided metal wire sleeve.

10. An arrangement as claimed in claim 1, wherein said connector and said transformer means are assembled into an integrated unit.

11. An arrangement as claimed in claim 1, wherein said magnetic circuit is formed of a plurality of toroidal cores of ferrite material.

12. An arrangement as claimed in claim 1, further comprising coaxially arranged output conductors, and said second winding having output leads connected to respective said output conductors.

13. An arrangement as claimed in claim 12, wherein said output conductors comprise mutually insulated coaxially arranged metal tubes having ends positioned adjacent respective said output leads.

* * * * *